United States Patent [19]

Colglazier et al.

[11] Patent Number: 4,990,967

[45] Date of Patent: Feb. 5, 1991

[54] COPYING METHOD AND APPARATUS

[75] Inventors: Donald F. Colglazier, Longmont; James H. Hubbard, Boulder, both of Colo.; Michael L. Morris, Fruit Heights, Utah; Robert T. Ritchie, Boulder, Colo.

[73] Assignee: International Business Machines Corporation, Armonk, N.Y.

[21] Appl. No.: 396,205

[22] Filed: Aug. 21, 1989

[51] Int. Cl.[5] ..... G03G 15/00

[52] U.S. Cl. ..... 355/323

[58] Field of Search ..... 355/323, 321, 322, 324, 355/319, 320, 314, 23, 24, 50; 271/285, 286, 287

[56] References Cited

U.S. PATENT DOCUMENTS

| | | | |
|---|---|---|---|
| 3,467,371 | 9/1969 | Britt et al. | 270/58 |
| 4,145,037 | 3/1979 | Mol | 270/58 |
| 4,192,607 | 3/1980 | Hage | 355/50 |
| 4,204,727 | 5/1980 | Tates | 355/3 R |
| 4,350,329 | 9/1982 | Holzhauser et al. | 271/9 |
| 4,433,836 | 2/1984 | Kulpa et al. | 271/3.1 |
| 4,442,505 | 4/1984 | Takano | 364/900 |
| 4,478,406 | 10/1984 | DuBois | 271/293 |
| 4,522,486 | 6/1985 | Clark et al. | 355/14 SH |
| 4,557,410 | 12/1985 | Holden et al. | 227/155 |
| 4,579,325 | 4/1986 | Pinckney et al. | 271/3.1 |
| 4,579,326 | 4/1986 | Pinckney et al. | 271/3.1 |
| 4,641,954 | 2/1987 | Miyata et al. | 355/323 X |
| 4,693,590 | 9/1987 | Umeda | 355/323 X |
| 4,727,398 | 2/1988 | Honjo et al. | 355/320 |
| 4,751,550 | 6/1988 | Murakama | 355/323 X |
| 4,864,350 | 9/1989 | Ishiguro | 355/323 X |
| 4,935,771 | 6/1990 | Ito | 355/323 X |

FOREIGN PATENT DOCUMENTS 3027146 2/1981 Fed. Rep. of Germany .

*Primary Examiner*—R. L. Moses

*Attorney, Agent, or Firm*—Charles E. Rohrer; Francis A. Sirr

[57] ABSTRACT

An electrophotographic copying apparatus includes a multi-function document feeder for feeding original document sheets to a platen viewing station for copying. The document feeder selectively provides (1) semi-automatic document feeding (SADF), (2) automatic document feeding (ADF), (3) recirculating automatic document feeding (RADF), and (4) manual placement of a document on the platen. A multi-function output copy module is provided for holding copies produced by the copying apparatus. The output module proivdes (1) a collator section comprising a vertical stack of collator bins, the unobstructed top bin of which also comprises (2) an exit tray, and (3) a large capacity exit bin that is located under the bottom one of the collator bins. The mode of operation of the output module is automatically determined in accordance with (1) the manner in which the operator elects to use the document feeder, and (2) the copier features, such as the number of copies or copy sets requested, use of a stapler, and/or job queuing, that are selected by the operator. In an embodiment of the invention, when a number of copy sets are to be made from an original set, the original set is first fed to the platen using the ADF. During this procss, the first copy set is produced. As the sheets thereafter leave the platen, the sheets are fed to the RADF. The original set is then recirculated to the platen, one recirculation for each of the remaining copy sets to be produced.

20 Claims, 12 Drawing Sheets

COPYING METHOD AND APPARATUS

DESCRIPTION

1. Field of the Invention

This invention relates to the field of photocopying, and more specifically to efficient original document sheet feeding and copy sheet handling in a copier apparatus.

Background of the Invention

In the art of photocopying, the visual image contained on an original document is viewed by a copier apparatus. This image is converted into a visual copy image that is then transferred to a sheet of substrate material, usually blank paper, as a copy is made of the original document. Two of the most desirable copier features comprises an original document feeder that feeds original document sheets to a viewing station for copying, and an exit or output module that handles the copy sheets produced by the copier apparatus. While many document feeders and copy handlers exist in the art, the need exists to improve their ease of operation and the range of functions provided by these devices.

Document feeders can be generally classified in the following manner.

Semi automatic document feeders (SADF) are constructed and arranged to allow an operator to manually position original document sheets at an SADF input station or tray, one sheet at a time. The SADF then feeds and positions the original document sheet at a viewing station for copying. After copying, the SADF ejects the sheet to an original document output tray, for retrieval by the operator. When a multi-sheet original document is to be copied, the operator must manually feed each individual document sheet to the SADF input station.

An automatic document feeder (ADF) is primarily adapted to enhance the copying of a multi-sheet original document. An ADF is provided with an input tray in which the entire original document is placed or stacked. The ADF then operates to feed the multi-sheet document to the copier viewing station, one sheet at a time, for copying. After each sheet has been copied a requested number of times, the sheet is ejected to the original document output tray. This type of document feeder relieves the operator from the task of feeding each individual sheet of the original document. When more than one copy set of a multi-sheet original document is requested by the operator, a multi-bin collator is usually provided to receive the output of the copier apparatus, one copy set per bin.

A recirculating automatic document feeder (RADF) provides a means of producing multiple copy sets of a multi-sheet original document without the need to provide a multi-bin collator. The RADF includes an input tray in which the entire original document is stacked. However, in this case the original document set is circulated to the viewing station for producing one copy of each sheet. After copying, the sheet is returned to the RADF input tray. In this way, the original document is circulated to the viewing station one time for each requested copy set. It is conventional that an RADF include an end-of-stack detector to enable the device to count the number of times that the original document has been recirculated for copying. When the last copy set has been produced, it is usual that the original document be feed to an original document output tray, for retrieval by the operator.

Whatever type document feeder is used, the feeder is usually movably mounted relative the copier's viewing station. This enables the document feeder to be manually moved away from the viewing station, thus allowing the operator to manually place an original document sheet at the viewing station, one sheet at a time.

When an RADF is used, the output module may comprise a large output bin in which the copy sets are accumulated, one on top of the other. The art provides various enhancement features in these single bin output modules. Examples are copy set separation by the way of positional offset of each copy set from its adjacent copy sets, and the binding of individual copy sets, for example by the use of a set accumulator tray in which each copy set is accumulated for binding or stapling prior to the bound copy set being ejected to the single bin output device.

An additional desirable copier feature provides a means whereby a long copy job may be temporarily interrupted by an operator having a small copy job.

In its broad scope and spirit, the present invention provides (1) document feeding means that includes the four functions of manual copying, SADF copying, ADF copying and RADF copying, and (2) an exit module or output copy handler having (1) a multi-bin collator section, one bin of which comprises (2) a copy sheet exit tray, and (3) a large capacity bin capable of holding a stack of copy sets. In accordance with the invention, the manner of use of the document feeding means, and the parameters of the requested copy job, automatically determine the manner in which the output handler operates, this manner of operation being the most efficient mode of operation for the particular copy job.

A feature of the present invention is that when more than one copy set is to be produced from a multi sheet original document, the ADF is used to make the first copy set and to then load the original document into the RADF, whereupon the RADF is thereafter used to make the remaining copy sets.

A further feature of the invention provides copy job queuing.

As previously stated, many document feeders and copy handlers exist in the art.

Document feeders of interest, in that multi-function devices are described, include U.S. Pat. Nos. 4,579,325 and 4,579,326 having document feeder means comprising an SADF and a bottom-feed, top-restack RADF, wherein the SADF is provided with the ability to interrupt an RADF copy job; U.S. Pat. No. 4,350,329 and German Offenlegungsschrift 3,027,146 are similar in that they show document feeding means having an SADF and an RADF function; U.S. Pat. No. 4,433,836 having document feeder means comprising an SADF and a bottom-feed, top-restack RADF, wherein the SADF is used to load the RADF as the first of a number of copy sets is produced, the RADF then being used to produce the remaining copy sets, and the RADF having an end of stack detector to enable detection of a complete circulation of a document set by the RADF; and U.S. Pat. No. 4,192,607 is generally similar in construction and arrangement to this later patent.

Copy handler art of interest, in that multi-function devices are described, include U.S. Pat. No. 3,467,371 which discloses a number of collator bins or catch trays that receive successive sheets of a copy set until such time as each bin includes a complete copy set. When the copy sheets are not to be collated into copy sets, the sheets are diverted into a large bin that also functions as an overflow bin, i.e. it is used to received sheets when a jam occurs in the collator bins; U.S. Pat. No. 4,145,037 which discloses a combined sorting and collating device. In the sorting mode of operation, successive copies of each document sheet are fed to a movable array of bins, until each bin contains a complete copy set. In the collate mode of operation, each of the bins receives a predetermined number of the same page of the document, and after all bins are thus loaded, a single sheet is ejected from each bin, to form a copy set, and the set is fed to an output tray; U.S. Pat. No. 4,204,727 which discloses a multi-function copy handler having a first deflector positioned at the entry of the handler. When this first deflector is in a first position, all copy sheet are fed in uncollated fashion to a tray, from which they are then manually unloaded. When this first deflector is in its alternate position, the sheets are fed onward to a second deflector. When this second deflector is in a first position, the sheets pass on to a vertical array of sorting trays or collator bins, and each bin then receives the sheets of a collated copy set, and the copy sets are are manually unloaded from the bins. When the copier is making copies of oversize original documents, the second deflector is set to its alternate position, and these "special" copies are routed to an external tray, where they are manually unloaded; U.S. Pat. No. 4,442,505 which describes a reproduction device in which the operator is able to define the "sorter output position" to be used for each reproduction job; U.S. Pat. No. 4,522,486 which describes an intelligent copier/collator apparatus wherein the operator provides input data relative the number of copy sets to be produced in a copy job, and the number of sheets in each copy set. The device's logic then forms virtual collator bins from a number of adjacent actual bins (if this is needed by the copy job data requirements). In addition, if the number of sets requested exceeds the number of available bins, excess sheets are sent to an overflow tray; and U.S. Pat. No. 4,693,590 which describes a copier/collator apparatus wherein the operator can load a number of different original document sets, having different copying requirements, into the tray of a document handler. These different sets are separated by divisions papers, having data means such as holes that are sensed by a sensor as an indication that one copy job has been completed, and that the next job can begin without operator intervention. The collator of this apparatus has an exit tray as well as plural collator bins. Copy sheets can be sent to the exit tray, or can be sent to the collator bins in either a sort mode (one copy sheet of the original to each bin) or a stack mode (all copies to one bin), dependent upon the copy job requirements.

The above patents are incorporated herein by reference for the purposes of illustrating the background of the invention and the state of the art.

SUMMARY OF THE INVENTION

This invention relates to document production, and more specifically to copier apparatus having a multi-function original document handler 20 and a multi-function output copy handler 30. In accordance with the invention, the mode of operation of the output copy handler is dependent upon, and is determined by, (1) the mode of operation that the operator selects for the original document handler, and (2) the copy job parameters that are defined by the operator, i.e. the mode of operation of the output copy handler is automatically set to be the most efficient mode of operation for each copy job that is defined by the operator.

In an embodiment of the invention, the original document handler can be used to copy original document sheets in one of four modes. The modes in which the original document sheets or sets may be copied are, (1) original document sheets are manually placed one at a time on a document glass or platen for the production of a requested number of copies of each sheet, i.e. manual copying, (2) the sheets are manually placed one at a time on an SADF entry tray for automatic feeding to the platen and for the production of a requested number of copies of each sheet, i.e. SADF copying, (3) the sheets are placed as a stack in an ADF entry tray for automatic feeding to the platen, one sheet at a time, for the production of a requested number of copies of each sheet, i.e. ADF copying, and (4) the sheets are placed as a stack in an RADF entry tray for automatic recirculation feeding to the platen, for the production of one copy of each sheet, and recirculation back to the stack for future feeding of the stack to the platen in order to produce the requested number of copy sets, i.e. RADF copying.

In an alternate construction of the original document handler of the invention, in the RADF mode of operation the sheets are placed as a stack in an ADF entry tray for automatic feeding to the platen, one sheet at a time, for the production of the first of a requested number of copy sets. The sheets are then fed to the RADF entry tray for automatic recirculation feeding to the platen for the production of the remaining number of the requested copy sets.

In accordance with an embodiment of the invention, the copier apparatus includes a multi-function output copy handler that has three modes of operation. That is, the copy sheets (1) may be sequentially stacked in the top bin 32 (i.e. the exit tray) of a vertical-bin collator 31, (2) may be sequentially placed one sheet at a time in each bin of the collator, or (3) may be stacked as a copy set in a large size exit pocket 33 that is located under the lowermost one of the collator bins.

In a preferred embodiment of the invention, the copier apparatus provides an exit paper path 12 through which copy sheets enter the copy handler, as the sheets move in a generally horizontal planar direction, and the output copy handler comprises a vertically movable stack of collator bins 31 having an open-top bin 32 and having a large exit pocket 33 disposed below the stack of bins.

In one construction and arrangement of the invention (FIG. 8), (1) when the document handler is operating in either the manual or the SADF mode of operation, with the collator function not selected, the stack of bins is positioned with its top bin located to receive all copy sheets, (2) when the document handler is operating in either the manual or the SADF mode of operation, with the collator function selected, the stack of bins is positioned with its top bin located to receive one copy sheet, and the stack of bins moves upward one bin per copy sheet, until the requested number of bins have all received a similar-image copy sheet, whereupon the collator moves downward, to again position the top, home-position, bin to receive a copy sheet, and the process repeats for the next document sheet, or, alternatively, the collator moves downward one bin at a time as each bin receives a copy sheet, (3) when the document handler is operating in the ADF mode of operation, and the copy job request is for only one copy, the stack of bins is positioned with its top bin located to receive all copy sheets, (4) when the document handler is operating in the ADF mode of operation, and the copy job request is for more than one copy, the stack of bins is positioned with its top bin located to receive the first copy sheet, and the bin stack moves upward one bin at a time, until the requested number of bins have all received a similar-image copy sheet, whereupon the collator moves downward, to again position the top bin to receive a copy sheet, and the process repeats for the next document sheet, as the stack of original document sheets is copied using the ADF function, (5) when the document handler is operating in the RADF mode of operation, and the copy job request is for only one copy (i.e. the equivalent of an ADF mode of operation), the stack of bins is positioned with its top bin located to receive all copy sheets, and (6) when the document handler is operating in the RADF mode of operation, and the copy job request is for more than one copy, the large exit pocket, disposed below the stack of bins, is positioned to receive all copy sets, and the bin stack moves downward as the stack of copy sets in this large exit pocket accumulates.

It is to be noted that in accordance with the invention, the bottom one of the collator bins could be the home-position or number-one bin, whereupon collated copy sets are produced as the collator bins index upward one bin at a time.

In another construction and arrangement of the invention (FIG. 9), above defined modes of operation (1)-(4) are similar. However, in this embodiment, for both the ADF and the RADF modes of operation the stack of original document sheets is initially placed in the ADF tray (FIGS. *7a–7c*). When only one copy is selected, operation proceeds as in (3) above, i.e. the stack of bins is positioned with its top bin located to receive all copy sheets. However, when more than one copy is selected, the first copy set is produced as these document sheets are fed from the ADF input tray, pass through the imaging station, and are then fed to the RADF input tray (FIG. *7a*). Thereafter, all subsequent copy sets are made by recirculating the original document through the imaging station using the RADF function (FIG. *7b*). All resulting copy sets are fed to the large exit pocket that is disposed below the stack of bins.

As a feature of the invention, a set binding means such as a stapler (FIG. 4) is provided at an accumulator tray that is located at the entry of the copy handler. When the staple function is selected as a copy job parameter, all resulting copy sets are fed to the large exit pocket that is disposed below the stack of bins.

As a further feature of the invention (FIGS. *7a–7c*), a first copy set is produced as the document sheets are fed from the ADF input tray, pass through the imaging station, and are then fed to the RADF input tray. Thereafter, all subsequent copy sets are made by recirculating the original document through the imaging station using the RADF function (FIG. *7b*).

Other features of the invention provide copy job interrupt (FIG. 10), use of the output module's large exit tray based when a copy request exceeds the number of available collator bins, or use of the stapled is requested (FIG. 11), and copy job set queuing in the ADF input tray (FIG. 12).

As will be apparent from the following detailed description, the invention automatically provides the most efficient operation of the copier apparatus for each requested copy job, as allowing the operator to select the most reliable manner of operating the original document handler, and the operator is relieved from the task of selecting the most efficient use of the multi-function output copy handler. Other advantages of the invention will be apparent to those of skill in the art upon reference to the following description, which makes reference to the drawing.

DETAILED DESCRIPTION OF THE INVENTION

The present invention, in its generic aspects, relates to a copier apparatus having a multi-function original document feeder and a multi-function output copy handler, wherein the mode of operation of the copy handler is determined in accordance with the mode of operation that is selected for the document feeder, and in accordance with other copy job parameters that are selected by the operator.

Figure 1:
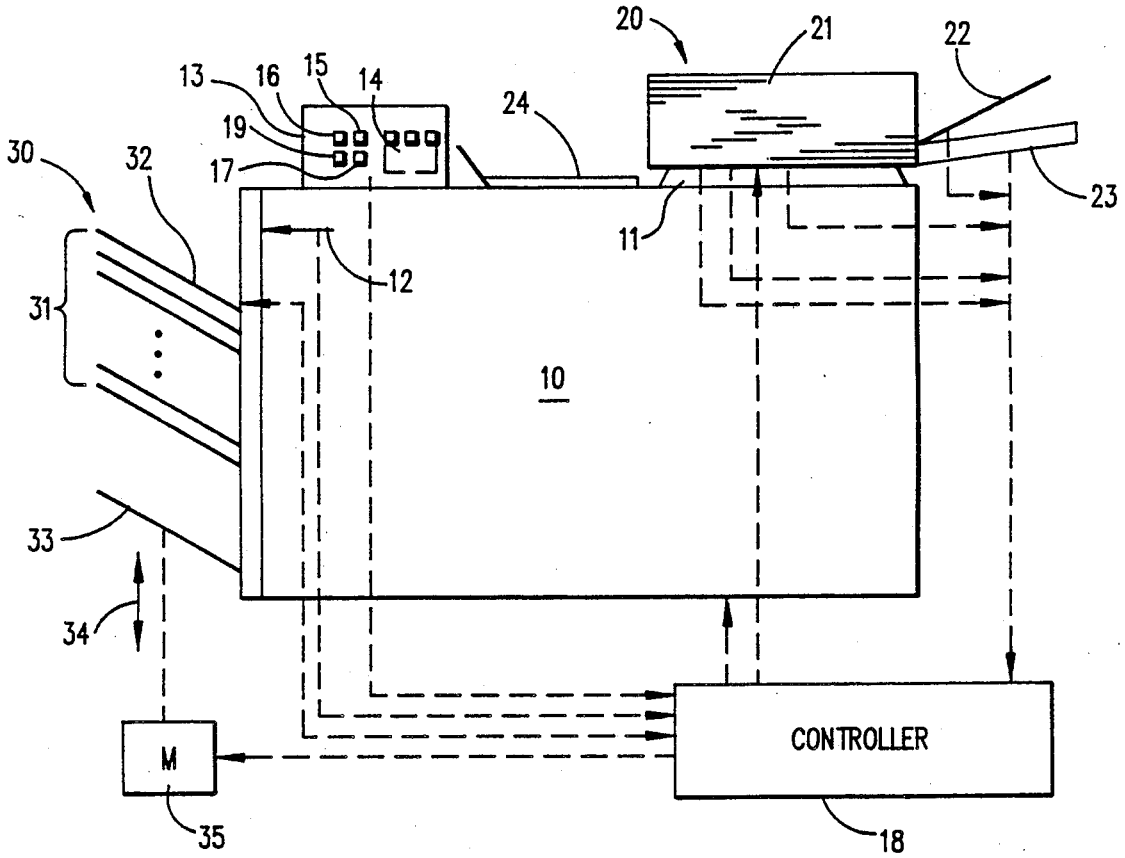
FIG. 1 is a front view of a copying apparatus having a copier engine, a document feeder and a copy handler in accordance with the invention.

FIG. 1 shows a copier engine 10 of any conventional construction and arrangement. Copier 10 is provided with an imaging station in the form of a glass platen 11. In a manner well known to those of skill in the art, a stationary original document on platen 11 is viewed by a optical means (not shown), and as a result thereof copies of this document issue out of copy exit path 12. A control panel 13 is provided whereby the operator may input data as to the parameters of a requested copy job or jobs. Control panels of this type, and the large variety of manual buttons or touch screens provided thereon, are well known to those skilled in the art. A contemporary control panel will not be described herein for the purposes of simplifying the description.

Figure 12:
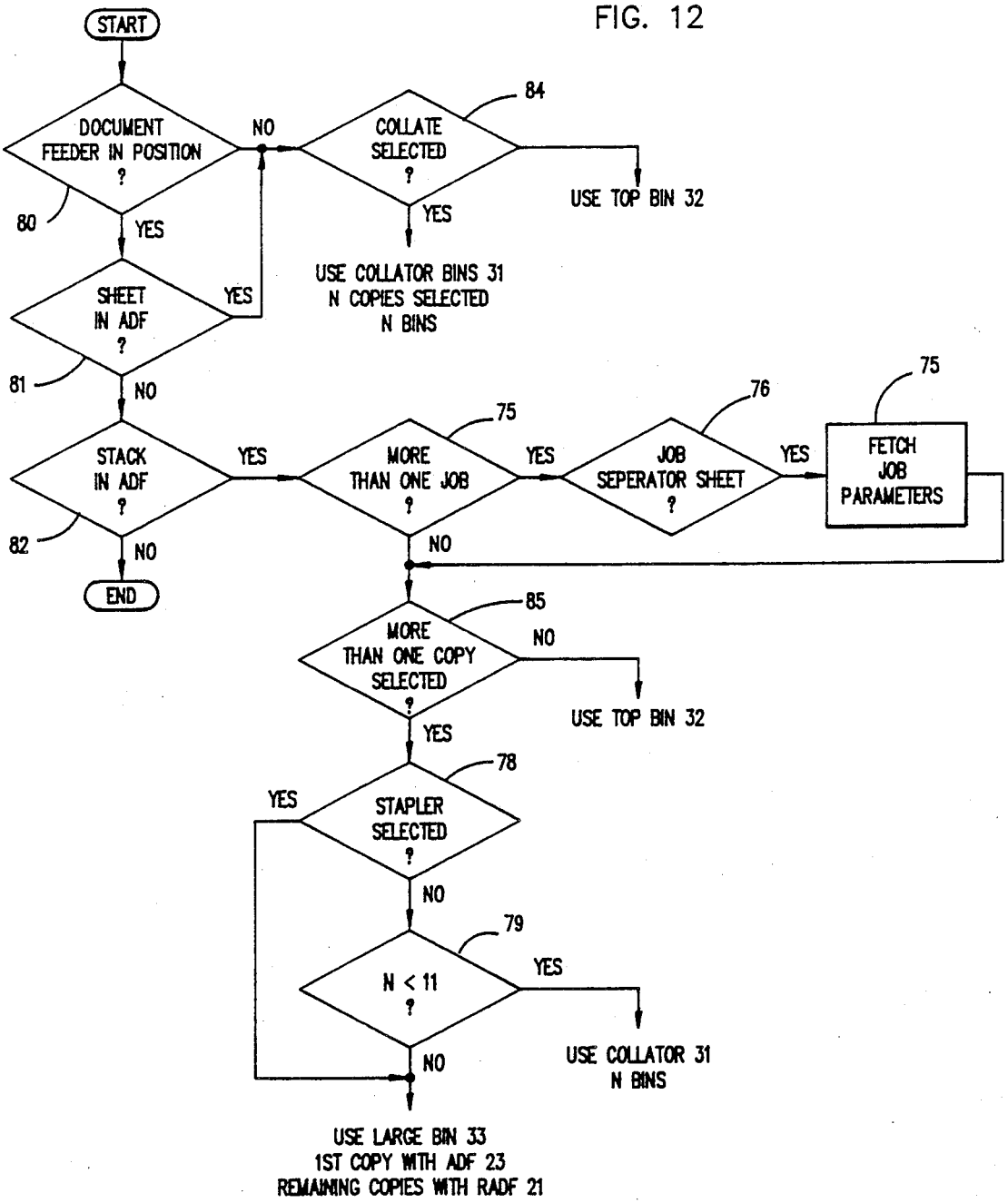
FIG. 12 is a controller means flow chart in accordance with the invention, which is somewhat like FIG. 11, this embodiment also showing the additional feature of job queuing, as this feature is implemented by job separator sheets and the sensor 54 within the document feeder of FIG. 2.

In accordance with the following description, buttons 14 provide for the entry of the number of copies/-sets that are requested by the operator, button 15 allows the operator to select the use of an output collator (to be described), button 16 allows the operator to select the use of a set stapler (to be described), button 17 is an interrupt request button, and button 19 allows the operator to indicate the number of jobs that have been placed (i.e. queued) in a document tray and whose job parameters have been or will be entered by way of the control panel, relative the feature of the invention shown in FIG. 12. In addition, control panel 13 may include a number of other conventional buttons, such as a start button and a stop button (not shown).

Operation of copier engine 10 is controlled by a microprocessor or controller 18, in a manner well known by those of skill in the art. Control panel 13 is connected to controller 18, and provides information thereto, including the copy job parameters that have been selected by the operator.

The multi-function document feeder of the invention is designated by number 20. Feeder 20 includes an RADF portion 21, an SADF portion 22, an ADF portion 23, and when feeder 20 is pivoted away from platen 11, an original document may be manually placed on platen 11 for manual copying. An original document exit tray 24 is provided by which the operator may retrieve original document sheets after an RADF, an ADF, or an SADF copy job has been completed.

As is well known, document feeder 20 includes a number of operational sensors that are connected to controller 18. For example, a sensor is provided to indicate that document feeder 20 has been moved away from platen 11. This sensor provides a signal to controller 18 indicating that a manual copy job may be following, this manual copy job being indicated by the subsequent actuation of a start button on control panel 13. In addition, document feeder 20 includes sensors to indicate that an original document, usually a stack of document sheets, has been placed in the ADF or in the RADF, or that a single document sheet is present in the SADF entry tray. When the RADF is in use, a set-separator sensor located therein indicates each time that the original document has been circulated to platen 11. Thus, if the copy job request is for ten copy sets, the occurrence of the tenth recirculation signal causes the original document sheets to be placed in exit tray 24 after production of the tenth copy set.

Reference numeral 30 identifies the multi-function copy handler of the invention. Copy handler 30 is shown in its first home position, for use of collator bins 31, or for use of the top bin 32 as a copy exit tray for all copies of the copy job, as will be explained. A second home position for copy handler 30 positions the lower large exit bin 33 to receive copy sheets from the copier's exit path 12. As is conventional, sensors are provided to sense passage of a copy sheet from path 12 to handler 30, and to provide an indication of the height of the paper in handler 30 relative the exit point of path 12. These sensors are likewise connected to controller 18. The vertical stack of paper trays that comprise copy handler 30 are bidirectionally vertically movable (see arrow 34) under the control of a motive means 35, as this motive means is controlled by controller 18.

As will be appreciated by those of skill in the art, the copier apparatus of FIG. 1 includes many other sensors to monitor and control proper operation of the apparatus. An example is in the field of jam detection and correction. For purposes of simplicity, all of these well known features have not been shown.

Figure 2:
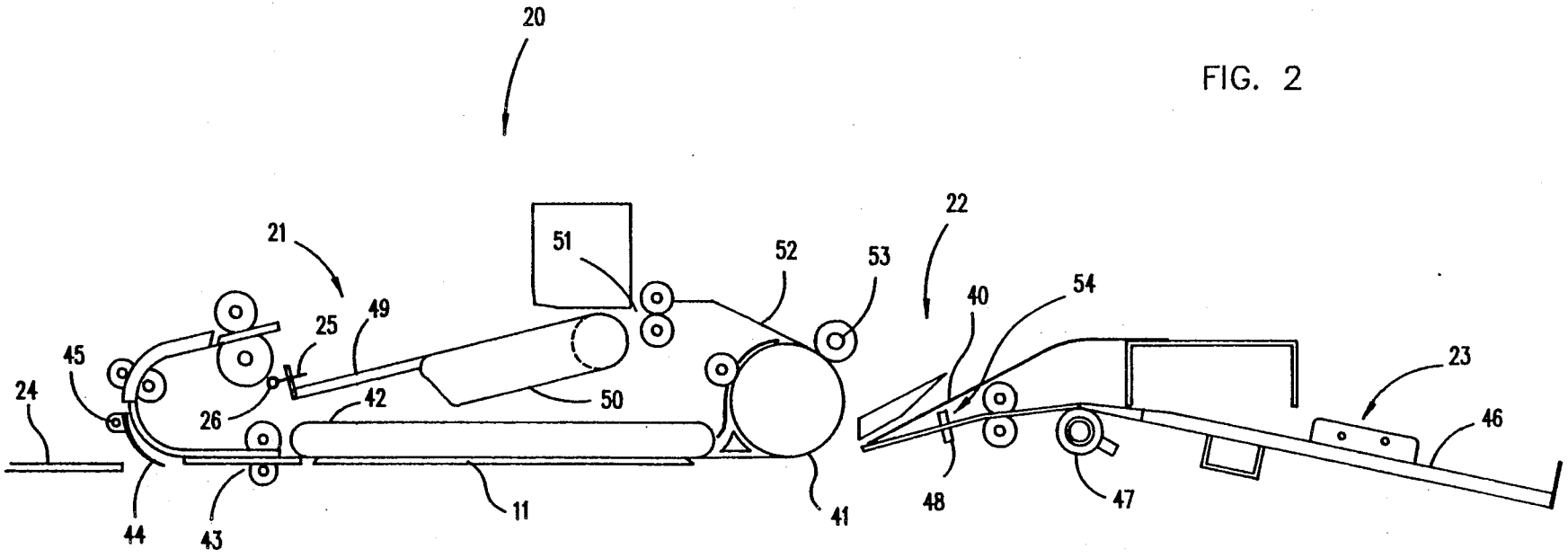
FIG. 2, is a front view of the multi-function document feeder used in FIG. 1, the document feeder of FIG. 2 being constructed and arranged to provide an additional job queuing feature of the invention.

While the individual operative portions 21, 22 and 23 of document feeder 20 shown in FIG. 1 may take a number of different detailed forms, all of which are well known to those of skill in the art and are to be considered within the spirit and scope of the invention, a preferred form of feeder 20 is shown in FIG. 2. In this document feeder, document sheets are placed in the SADF and the ADF with the image side facing downward, whereas document sheets are placed in the RADF with the image side facing upward. ADF portion 23 is a bottom-feed document feeder, whereas RADF portion 21 is a bottom-feed/top-restack document feeder.

When feeder 20 is operating in the SADF mode, the operator inserts each document sheet into entry tray 40, image side facing down. The sheet is then advanced to platen 11 by operation of roller 41 and belt 42. The document is stopped on platen 11 for copying, and is then ejected into exit tray 24 by operation of belt 42 and rollers 43. Sheet deflector 44 is at this time in an elevated position. Deflector 44 rotates about its pivot 45.

When feeder 20 is operating in the ADF mode, the operator inserts the original document, usually comprising a stack of document sheets, into entry tray 46, image side facing down. This device is a bottom-feed device. The stack of sheets is then fed, one sheet at a time, to platen 11, under the influence of feed roller 47, feed rollers 48, feed roller 41 and belt 42. The document is stopped on platen 11 for copying. The document is thereafter ejected into exit tray 24 by operation of belt 42 and rollers 43. Sheet deflector 44 is at this time in its elevated position.

When feeder 20 is operating in its RADF mode, the operator inserts the original document, usually comprising a stack of document sheets, into entry tray 49, image side facing up. This device is a bottom-feed/top-restack device. The stack of sheets is then fed, one sheet at a time, to platen 11, under the influence of belt 50, feed rollers 51, sheet guide 52, feed roller 41 and its idle roller 53 and belt 42. The document is stopped on platen 11 for copying. One copy of each document sheet is made. For the major portion of this mode of operation, sheet deflector 44 is positioned as shown in FIG. 2. In this position of deflector 44, the document sheet is returned to the top of the stack of tray 49 after copying.

Set separator 25 separates the lower sheets of a document set (i.e. the sheets awaiting feeding to platen 11) from the upper, already copied sheets that have been restacked on tray 49. Separator 25 may take many forms, known to those of skill in the art. This particular separator is biased for CW rotation about its pivot 26. When the underlying last sheet of the document set is fed to platen 11, and has been returned to the top of the stack on tray 49, separator 25 completes its CW rotation, and comes to rest upon the top of the stack. In this way, the original stack of sheets is circulated to platen 11, one circulation per requested copy set. Operation of set separator 25 enables controller 18 (FIG. 1) to count circulation of the original set, and to thus monitor completion of the copy job.

When the original set has been copied for the last requested time, the sheets of the original document set are fed to tray 49, where the set then resides in correct page order for retrieval by the operator.

Figure 3:
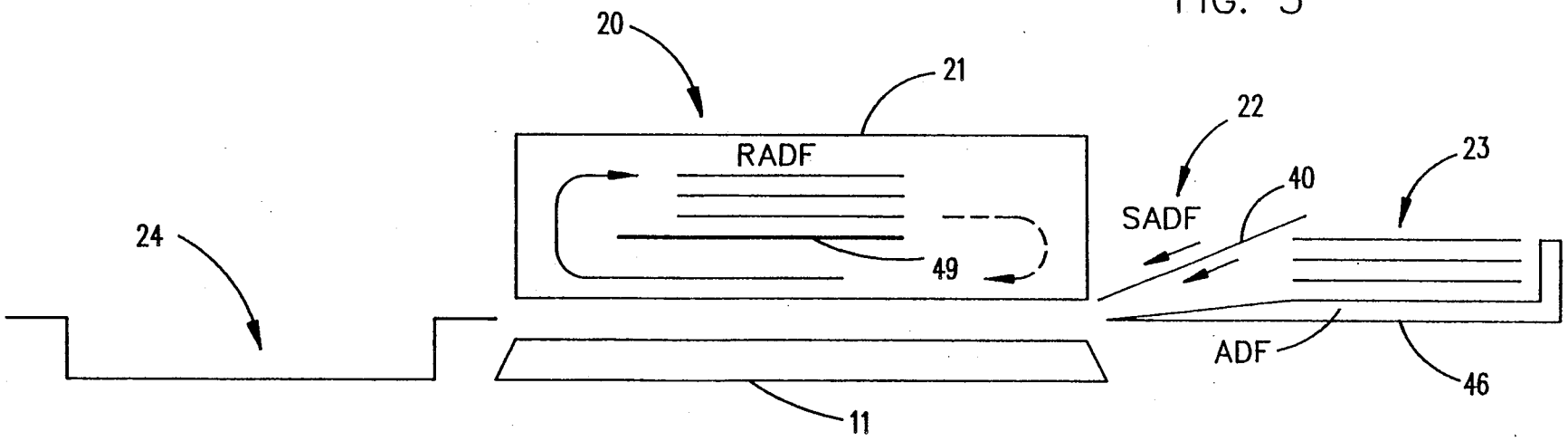
FIG. 3 is a simplified view of the document feeder of FIG. 2, showing in a simplified manner the ways which the document feeder operates.

FIG. 3 is a simplified schematic showing of the document feeder of FIG. 2.

As will be appreciated by those skilled in the art, a wide variety of the SADF, ADF and RADF document feeders existing in the art can be combined to form a document feeder having the characteristics of feeder 20 shown in FIG. 3, and such combinations are to be considered as within the scope and spirit of the invention.

In addition, such document feeders may, within the teachings of the invention, provide for the copying of both simplex and duplex image original documents.

The document feeder of FIG. 2 includes a feature of the invention whereby a number of different original document sets may be queued in ADF tray 46. In other words, a number of different original documents or sets, each set of which comprises a different copy job, and each set of which usually comprises a number of sheets, may be stacked in ADF tray 46. Each of these copy jobs may have different copy job parameters, for example the number of copy sets requested may be different for each copy job. Each of these original document sets is separated from the upper adjacent set by a separator sheet of a unique construction and arrangement. To facilitate this feature, a light-source/optical-sensor 54 is provided to project a beam of light across the exit path of the ADF. Sensor 54 operates to detect a unique characteristic of a separator sheet, as the sheet is fed to platen 11 by the ADF. For example, document sets that are queued in tray 46 are separated by a job separator sheet having a hole, or a series of holes, therein that is detected by sensor 54, as an indication that a new copy job is beginning. As a part of the job queuing mode of operation, the operator uses control panel button 19 to indicate to controller 18 the number of sequential different copy job parameters that have been entered by way of the control panel. When controller 18 receives an output from sensor 54, indication that a copy job boundary has arrived, controlled 18 fetches the job parameters for the new job from memory (not shown, and implements copying of this new set of original document sheets in accordance with these new job parameters, and in accordance with the invention. If desired, the above mentioned job separator sheet may include text information, in which case the set separator sheet is copied, and becomes part of the copy set(s), for later use. This feature of the invention is described in greater detail relative FIG. 12.

While a particular means for providing a job queuing feature has been disclosed, other means are well known to those skilled in the art, and the the invention is not to be limited to the specific arrangement described.

As above described, the multi-function original document handler or feeder 20 of the invention selectively operates in one of four modes of operation, i.e. in RADF, ADF and SADF modes, and when feeder 20 is pivoted upward to expose platen 11, documents can be manually placed on platen 11 for copying.

Figure 4:
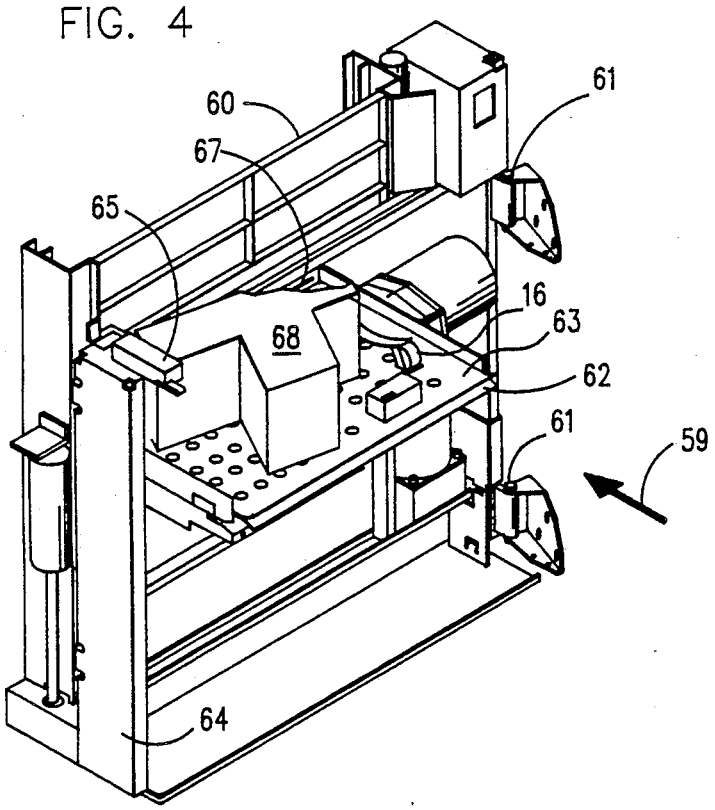
FIGS. 4, 5 and 6 show an embodiment of the multi-function copy handler of FIG. 1, FIG. 4 differing from FIG. 6 in that a stapler 68 is shown at the location of set accumulator tray 62,63, FIGS. *7a*, *7b* and *7c* show a feature of the invention wherein an original document set is placed in the document tray of ADF 21, a first copy set is produced as the original set is concurrently loaded into the document tray 49 of RADF 21 (FIG. *7a*), the remaining copy sets are thereafter produced by RADF recirculation (FIG. *7b*), and after the last copy set has been produced by operation of RADF 21, the original set is placed in the document feeder's exit tray 24 for retrieval by the operator (FIG. *7c*)
Figure 5:
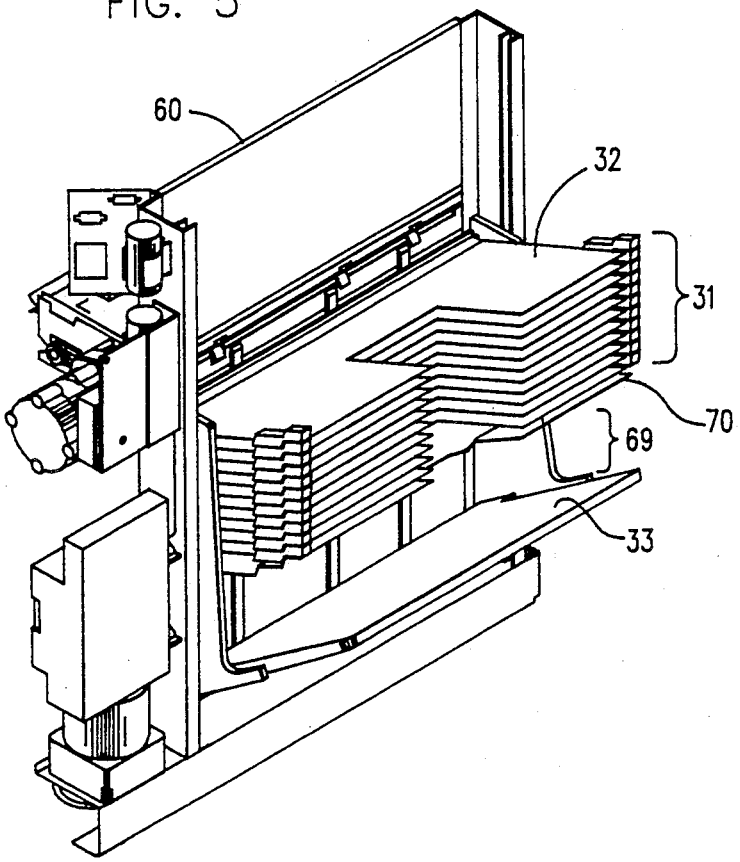
Figure 6:
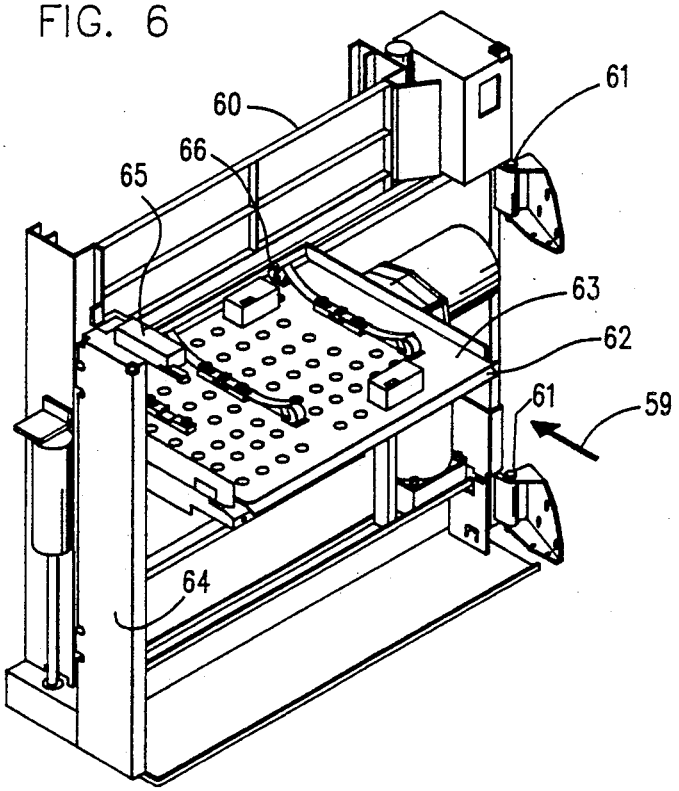

The multi-function output copy handler or module 30 of the invention has three copy sheet output areas which comprise, in the preferred device shown in FIGS. 4–6, a 150 sheet capacity exit tray 32, a ten bin collator 31, each bin having a capacity of 100 sheets, and a large 1000 sheet capacity stacker tray or bin 33.

In the preferred embodiment of the invention, a hot roll fusing station (not shown) was provided in copier engine 10 to move copy sheets at the rate of about 45 inches per second. As a sheet leaves the fusing nip, it moves in the X direction (see arrow 59 of FIGS. 4 and 6), and in a horizontal X-Y plane.

The output copy handler of FIGS. 4–6 includes a four-sided, open, metallic frame member 60 in the shape of a rectangle whose major axis extends in the vertical Z direction. Frame member 60 is pivoted at 61 to the back left side of the copier frame (as viewed from the front of copier 10, FIGS. 4 and 6) on a vertically extending Z direction pivot axis that is located at the rear of copier 10. As viewed from the front of copier 10, metal collator bins 31 are cantilevered off of frame member 60, and extend to the left thereof. The floor of the bins 31 are inclined upward, at an angle of about 30 degrees to the horizontal.

Again as viewed from the front of copier 10, the sheet entry path 12 (FIG. 1) that extends to output module 30 is formed by a pair of vertically spaced, flat, metal plates 62 and 63 (FIGS. 4 and 6) that extend horizontally, in the X-Y plane, to the right of output module frame 60. The front vertical portion 64 of module frame member 60 couples to the copier frame by way of a releasable catch 65. When catch 65 is released, the operator can manually swing frame member 60 backward (CW as viewed from above). This movement opens output module 30 for jam clearance, maintenance and the like.

The above mentioned sheet entry path 62,63 accepts sheets leaving the copier's hot roll fuser nip, as the sheets move at a speed of 45 inches per second. Module 30 operates to slow the sheets down to ½ this speed, i.e. 22½ inches per second. This is done by the use of four drive rollers that are located in bottom plate 62 of the entry path, and by four mating idler rollers 66 that are located in the top plate 63 of the entry path. These drive rollers are controlled by a 2-speed AC motor and a microprocessor (not shown). The horizontal X distance between the copier's fusing nip and rollers 66 is such that a sheet's trailing edge has left the driving influence of the fusing nip before the sheet's leading edge moves into the influence of rollers 66 and under the control of the microprocessor.

In the embodiment of FIG. 4, entry path 62,63 includes a movable exit gate 67 and a selectively usable stapler 68 that is located adjacent the front edge of a copy set that is resident in entry path 62,63. Stapler 68 may be of the type shown in U.S. Pat. No. 4,557,410, incorporated herein by reference.

Stapler 68 may be movable, front to back, in the Y direction, in order to allow the stapler to cooperate with either leading edge corner of the copy set. In this embodiment, entry path 62,63 operates as a copy set accumulator when gate 67 is closed. Sheet driving rollers 66 (FIG. 6) are then operated, and gate 67 is opened, only after a copy set has been accumulated in entry path 62,63, and stapled by stapler 68, if use of the stapler has been selected by a button on control panel 13 (FIG. 1).

The collator bins per se, and the bin moving mechanism, are of the type generally disclosed in U.S. Pat. No. 4,478,406 incorporated herein by reference. The arrangement of FIGS. 4–6 differs from the arrangement of this patent in that the device of FIGS. 4–6 is essentially a twenty bin collator of the type shown in this patent, each bin being of 100 sheet capacity, wherein nine of the bottom bins of a twenty bin collator have been removed, to leave a large 1000 sheet capacity gap 69 of FIG. 5.

Gap 69 is bounded on the bottom by the floor of the bottom-most bin 33. The floor of bin 33 comprises the 1000 sheet stacker bin contained within gap 69. The top of gap 69 is bounded by the floor 70 of the bottom-most bin of ten bin collator 31.

The 1000 sheet gap 69 that exists above the bottom located stacker bin 33 includes the drive pins that were associated with the nine removed bins. Thus, the bin driving cam of above mentioned U.S. Pat. No. 4,478,406 cooperates with these pins to move stacker bin floor 33 down, in small steps, as the stack height of the sheets in stacker bin 33 increases. A reflective light sensor (not shown) may be provided to sense this stack height, or alternatively sheets may be counted as they enter stacker bin 33.

The roof 32 of the top collator bin (i.e. the collator bin roof having no member above it) comprises a 150 sheet capacity exit pocket or tray.

Thus it can be seen that, in sequential order from top to bottom, output module 30 comprises (1) a 150 sheet capacitY exit tray 32, (2) ten 100 sheet capacity collator bins 31, numbered one through ten from top to bottom, and (3) the 1000 sheet stacker bin 33.

The method of manufacturing the copier apparatus of the invention is such that copier engine 10, with an attached output module frame 60, is shipped to a customer. Accompanying the order is an attachable entry path member 62,63, which may be a simple path member, or an accumulator tray member, with or without stapler 68, and whatever configuration of collator/-stacker bins the customer requires.

The moving bin arrangement of FIGS. 4–6 has two home positions relative exit path members 62,63, i.e. (1) a lowered home position where exit tray 32 (i.e. the roof of the top collator bin) is positioned to receive sheets from exit path members 62,63, and (2) a raised home position where the floor of stacker bin 33 is positioned to receive sheets from exit path members 62,63.

When output module 30 is to operate in the lowered exit pocket mode, motive means 34 (FIG. 1) positions the top exit tray 32 at exit members 62,63, but does not index up to the next bin, and the copy job is limited to 150 sheets.

When output module 30 is to operate in the collate mode, the top bin of bins 31 receives the first copy sheet, and motive means 35 indexes up one bin for the next sheet, etc.

When output module 30 is to operate in the raised stacker mode, with exit path members 62,63 operating as an accumulator tray and stapler 68 selected for use, stacker bin floor 33 is positioned at exit members 62,63, and motive means 35 indexes down, a step at a time, as motive means 35 is controlled by controller 18 and a stack height sensor, and as the sheet stack builds up in stacker bin 33 (sheets may be counted, or the stack height may be sensed by reflection of a light beam or the like).

When exit path members 62,63 are to operate as an accumulator tray, with stapler 68 not selected for use, the top one of collator bins 31 is positioned at the exit of the accumulator tray, and motive means 35 is operated to thereafter raise collator bins 31, one bin at a time, as copy sets exit the accumulator tray.

Provision is also made for copy set separation. The drive rollers at the exit of the members 62,63, that is the two drive rollers directly under the two idler rollers 66 that are adjacent gate 67 (FIG. 6), are solenoid controlled to pivot about a vertical axis (the corresponding idler rollers 66 need not pivot) so as to send copy paper selectively toward the front or toward the rear of the copier, i.e. a component of movement in the Y direction. Normally, these drive rollers are not angled, and they send paper straight ahead, i.e. in the same X direction as the sheets moved as they exit the fuser nip. By sending alternate copy sets in the X direction with a component of movement in the Y direction, alternate copy sets on stacker bin 33 are positionally offset.

FIGS. *7a–7b* are simplified schematic showings of the document feeder of FIG. 2 which embodies a feature of the invention whereby ADF 23 may be used to load RADF 21 after a first copy set has been produced using the ADF. While this feature of the invention will be described as above mentioned, it is also within the spirit and scope of the invention to use SADF 22 to load RADF 21 after a first copy set has been produced using the SADF.

In FIGS. *7a–7b*, when document feeder 20 operates in the RADF set production mode ADF 23 is used to make the first copy set and to concurrently load the original document into the RADF document tray. The RADF is thereafter used to make all subsequent copy sets of a requested copy job.

In this embodiment of the invention, the original document set is loaded into the document tray of ADF 23 (FIG. *7a*). The operator then indicates to controller 18 that the requested copy job is to be a set-production copy job. This may be done by way of a button on control panel 13, or alternatively by a button or other means on document feeder 20 itself, for example by raising a cover (not shown) for RADF document tray 49.

When this copy job request is received, controller 18 controls copier engine 10 and document feeder 20 to feed the sheets of the original document to platen 11, where they are copied one time each. This operation produces the first copy set of the requested copy job. The original document sheets leave platen 11 after copying, and are fed to the document or entry tray 49 of RADF 21 (see FIG. *7a*) due to the fact that sheet deflector 44 (see FIG. 2) is in its lowered position. When ADF 23 is detected to be empty of sheets, RADF 21 is activated to circulate the original document to platen 11. One such circulation occurs for each of the remaining copy sets of the requested copy job (see FIG. *7b*). When it is determined that the last circulation of the original document set to platen 11 is underway, for example by way of set separator 25 (FIG. 2), sheet deflector 44 of document feeder 20 is raised, and the original document sheets exit to original document exit tray 24 in correct page order (see FIG. 7*c*), for retrieval by the operator.

FIGS. 8, 9, 10, 11 and 12 show controller means flow charts of embodiments of the present invention, i.e. the modes of operation of controller 18 relative embodiments of the invention.

Figure 8:
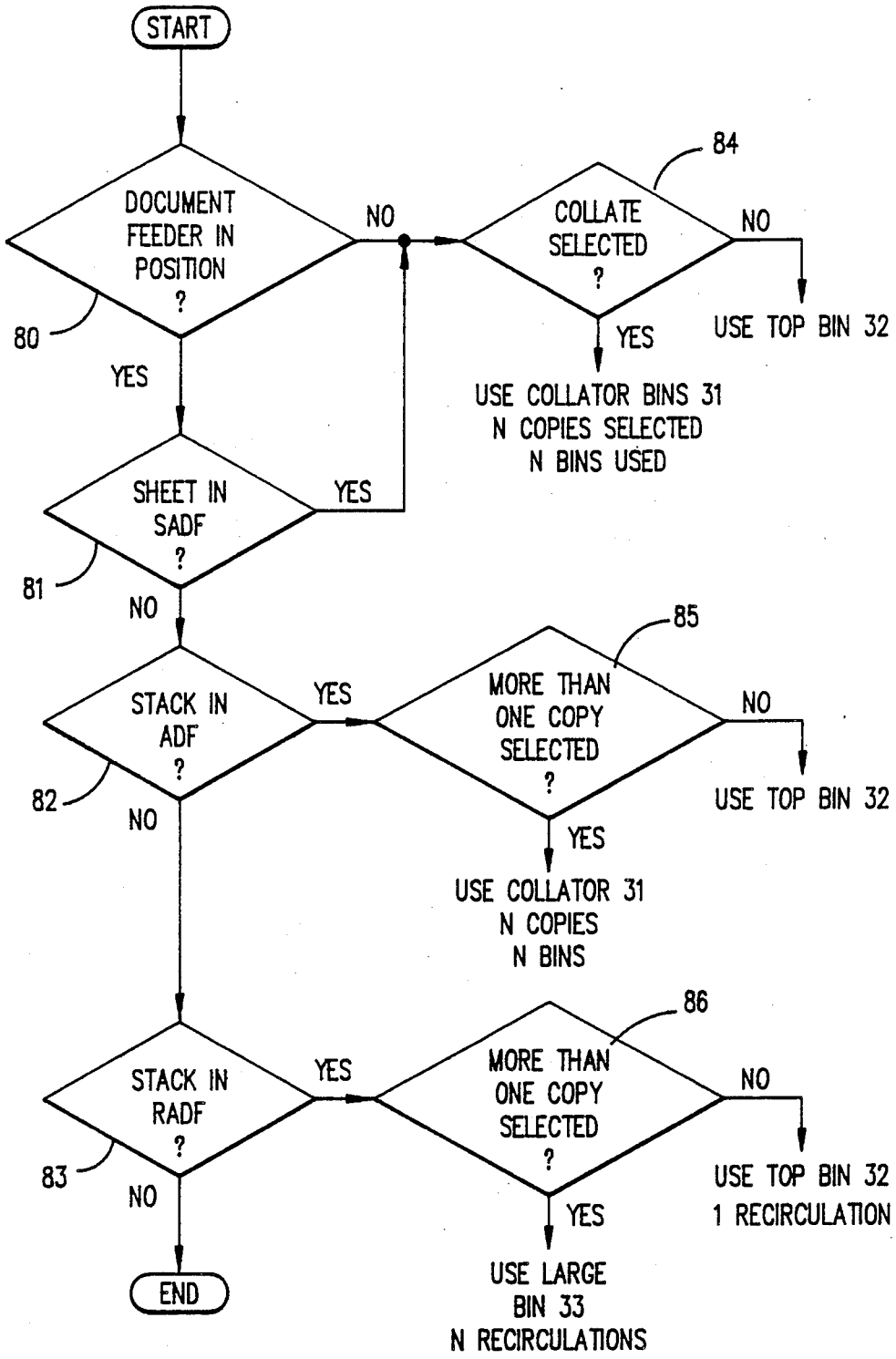
FIG. 8 is a controller means 18 flow chart showing an embodiment of the invention wherein the mode of operation of the multi-function copy handler of FIGS. 4, 5 and 6 is determined by the operator's selection of a collate function, the number of copies requested, and the manner in which the operator has elected to use the multi-function document feeder of FIGS. 2 and 3.

FIG. 8 provides control means for use with the document feeder 20 of FIGS. 2 and 3, that is a document feeder that allows the operator to selectively use SADF 22, ADF 23, RADF 21, or to manually pivot document feeder 20 away from platen 11 for manual copying.

In FIG. 8, decision block 80 determines if document feeder 20 is in position over platen 11, decision block 81 determines if an original document sheet has been inserted into SADF entry tray 40, decision block 82 determines if an original document set has been inserted into ADF entry tray 46, and decision block 83 determines if an original document set has been inserted into RADF entry tray 49.

When document feeder 20 is not in position for use (i.e. an indication of a manual copy job request), decision block 84 determines if collator 31 has been selected for use by the operator. When the collator has not been selected, copy handler 30 is controlled by motive means 35 to locate the top bin 32 at copier exit path 12 (i.e. members 62,63 of FIGS. 4 and 6), and all copy sheets are supplied to bin 32. When the collator has been selected, copy handler 30 is controlled by motive means 35 to locate the top collator bin at copier exit path 12, and all copy sheets are supplied to collator bins 31. In this situation, if the copy request is for N copies ($N<11$), then the top N bins of collator 31 are used for the copy job.

When document feeder 20 is in position for use, decision block 81 determines if a document sheet has been placed in the entry tray of SADF 22. If such a sheet exists (i.e. an indication of a request for an SADF copy job), decision block 84 again determines if collator 31 has been selected for use by the operator, and the SADF supported copy job proceeds as above described relative a manual copy job.

When document feeder 20 is in position for use, decision block 82 determines if a stack of document sheets has been placed in the entry tray of ADF 23. If such a stack exists (i.e. an indication of a request for an ADF copy job), decision block 85 determines if more than one copy has been requested by the operator. If only one copy has been requested, copy handler 30 is controlled by motive means 35 to locate the top bin 32 at copier exit path 12, and all copy sheets (i.e. one copy sheet for each original document sheet) are supplied to bin 32. If more than one copy has been requested, copy handler 30 is controlled by motive means 35 to locate the top collator bin at copier exit path 12, and the copy sheets are supplied to collator bins 31. In this situation, if the copy request is for N copies ($N<11$), then each original document sheet is copied N times and thereafter deposited in exit tray 24. The top N bins of collator 31 are used for the copy job, each of these bins receiving a copy set of the original document set, as the collator increments up N bins during the copying of each original document sheet, and then returns the top collator bin to exit path 12 in preparation for the copying of the next document sheet.

When document feeder 20 is in position for use, decision block 86 determines if a stack of document sheets has been placed in the entry tray 49 of RADF 21. If such a stack exists (i.e. an indication of a request for an RADF copy job), decision block 86 determines if more than one copy has been requested by the operator. If only one copy has been requested, copy handler 30 is controlled by motive means 35 to locate the top bin 32 at copier exit path 12, the document is circulated to platen 11 one time and then returned to tray 49 in correct page order, and all copy sheets (i.e. one copy sheet for each original document sheet) are supplied to bin 32. If more than one copy has been requested, copy handler 30 is controlled by motive means 35 to locate large bin 33 at copier exit path 12, and all copy sheets are supplied to this bin. In this situation, if the copy request is for M copies, the original document set is circulated to platen 11 M times and concurrent with the last circulation, the document set is deposited in tray 49 in correct page order.

Figure 7A:
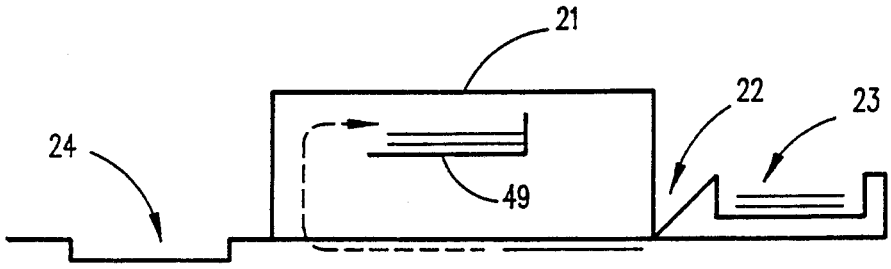
Figure 7B:
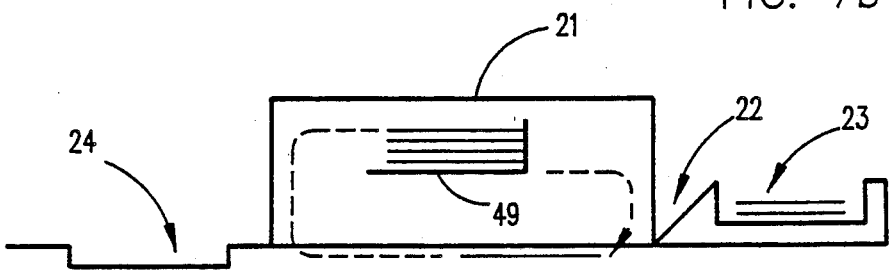
Figure 7C:
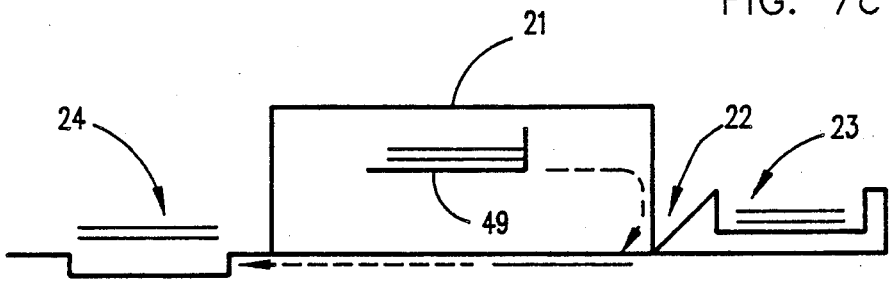
Figure 9:
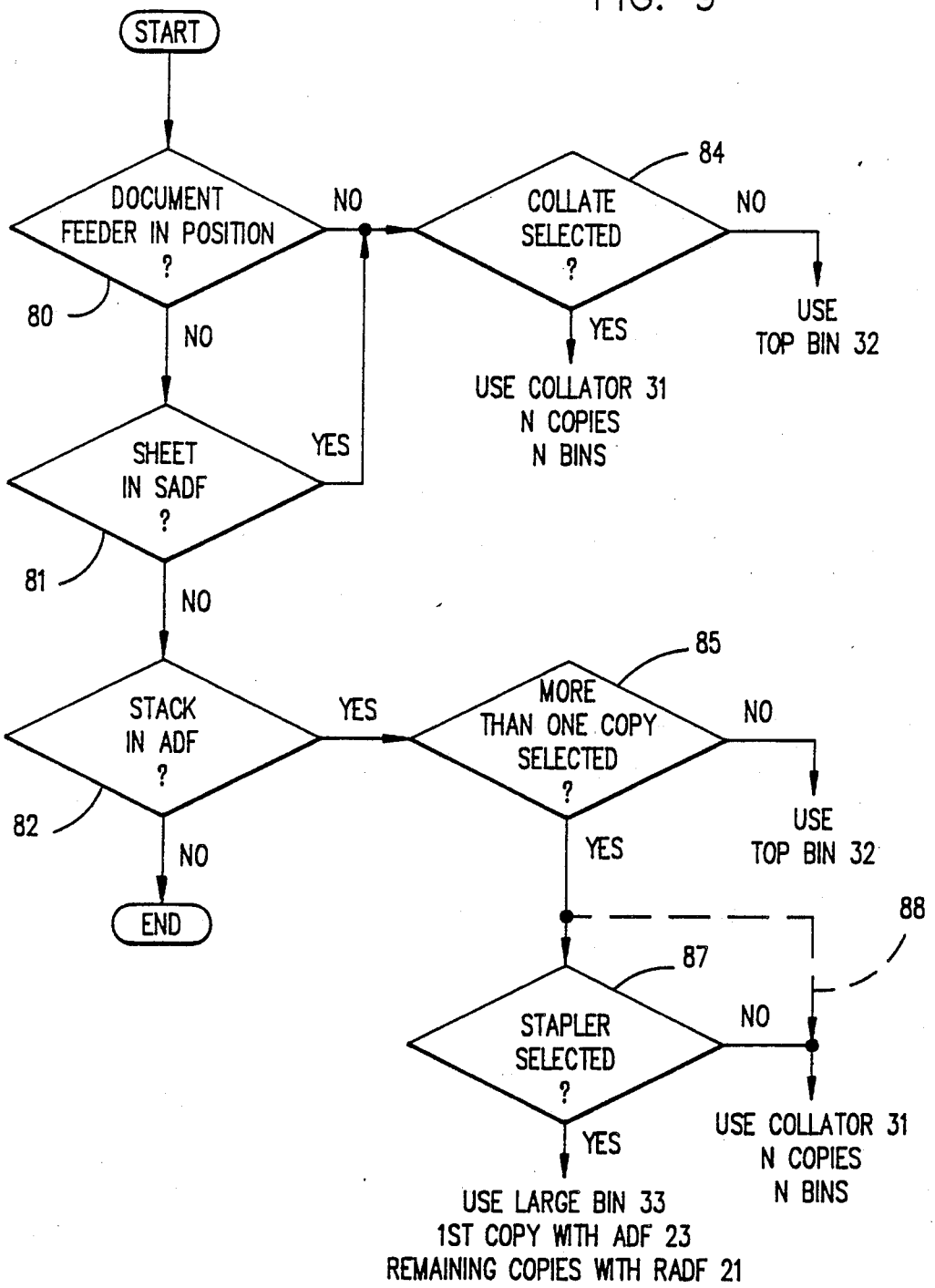
FIG. 9 is a controller means flow chart showing an embodiment of the invention in accordance with FIGS. *7a–7c* where operation of the ADF may load the RADF, and showing a variation thereof wherein the stapler of FIG. 4 may be additionally selected for use by the operator.

FIG. 9 provides control means for use with the document feeder 20 of FIGS. 7*a*–7*b*, i.e. with a document feeder that allows the operator to selectively use SADF 22, ADF 23, or to manually pivot document feeder 20 away from platen 11 for manual copying. In this embodiment of the invention, an original document stack that has been loaded into the ADF entry tray may be fed into the entry tray of the RADF for circulation to platen 11, as will be explained.

FIG. 9 shows a control means embodiment wherein the operator may have also elected to use stapler 68 of FIG. 4.

As can be seen by comparing FIGS. 8 and 9, decision blocks 80, 81, 82, 84 and 85 result in the same means of control as above described when a stapler 68 is not provided (see broken line 88 of FIG. 9). However, when a stapler is provided, and its use is selected, as is determined by decision block 87, copy handler 30 is controlled by motive means 35 to locate large bin 33 at copier exit path 12, and all copy sheets are supplied to this bin. In this situation, the first copy set is produced as ADF 23 feeds the original document set to platen 11 for one-time copying, and as the original document is thereafter stacked in the entry tray 49 of RADF 21 (see FIG. 7*a*). If M copy sets have been requested, the original document set is now circulated to platen 11 M-1 times for one-time copying during each of the M-1 circulations (see FIG. 7*b*). After copying of the document set for the Mth time, the document set is placed in exit tray 24 for retrieval by the operator (see FIG. 7*c*).

Figure 10:
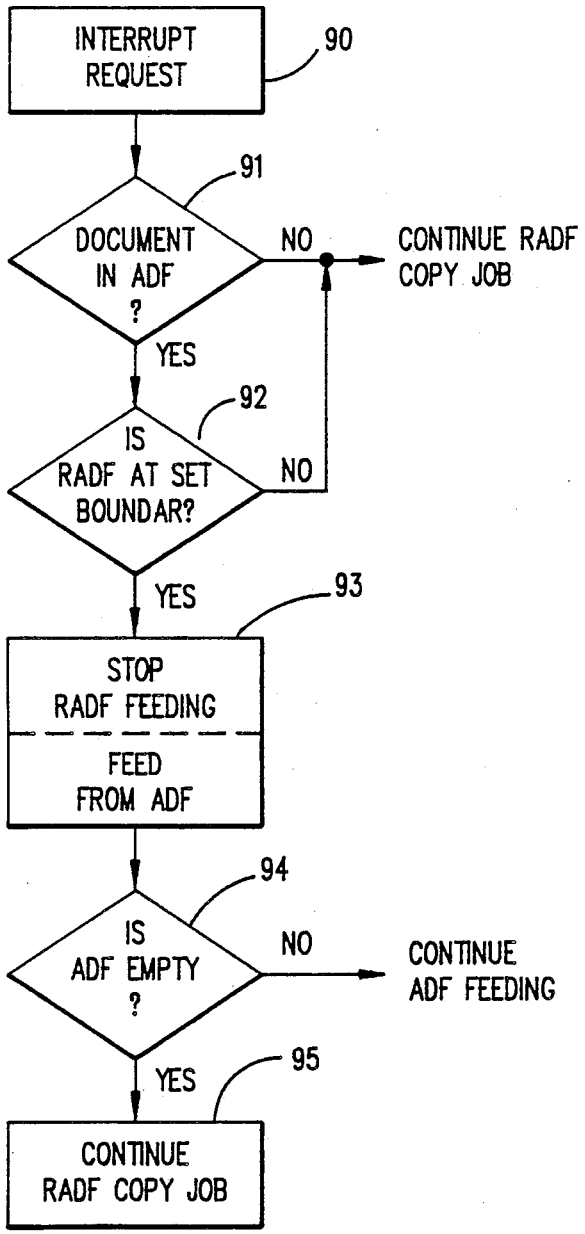
FIG. 10 is a controller means flow chart in accordance with the invention wherein an interrupt sequence is initiated by the operator by means including the placing of an original document set in the document feeder's ADF entry tray, to thereby interrupt an RADF copy job.

As has been mentioned, a feature of the invention provides for copy job interrupt, for example the interruption of an RADF copy job by an ADF copy job. While SADF 22 can also be used to facilitate the interrupt function, the following description will be limited to use of ADF 23 for purposes of simplicity. FIG. 10 shows this interrupt control mode. In this figure it will be assumed that interrupt request event 90 occurs while an RADF copy job is in progress, and while large exit bin 33 of copy handler 30 is in use.

When event 90 occurs, decision block 91 determines if an original document has been placed in ADF entry tray 46. Until an original document is detected in tray 46, the RADF copy job continues. When a document is detected in tray 46, decision block 92 next determines if operation of the RADF has reached a set boundary, as is determined by set separator 25 of FIG. 2. Until a set boundary is reached, the RADF copy job continues.

When a set boundary is detected by decision block 92, event 93 occurs, i.e. the RADF copy job is interrupted, and the ADF copy job begins. Since copy sets reside in large bin 33 at this time, copy handler 30 is controlled by motive means 35 to locate top bin 32 at copy exit path 12, either for use as a single exit tray, or for the top one of the collator bins 31 may be located at copy exit path 12, for use in the interrupting ADF copy job. The ADF copy job continues until decision block 94 determines that ADF entry tray 46 is empty, whereupon event 95 occurs, and the interrupted RADF copy job restarts where it left off, again using large bin 33, FIG. 11 shows a controller means flow chart for use with the document feeder 20 of FIGS. *7a–7b*, i.e. with a document feeder that allows the operator to selectively use SADF 22, ADF 23, or to manually pivot document feeder 20 away from platen 11 for manual copying.

Figure 11:
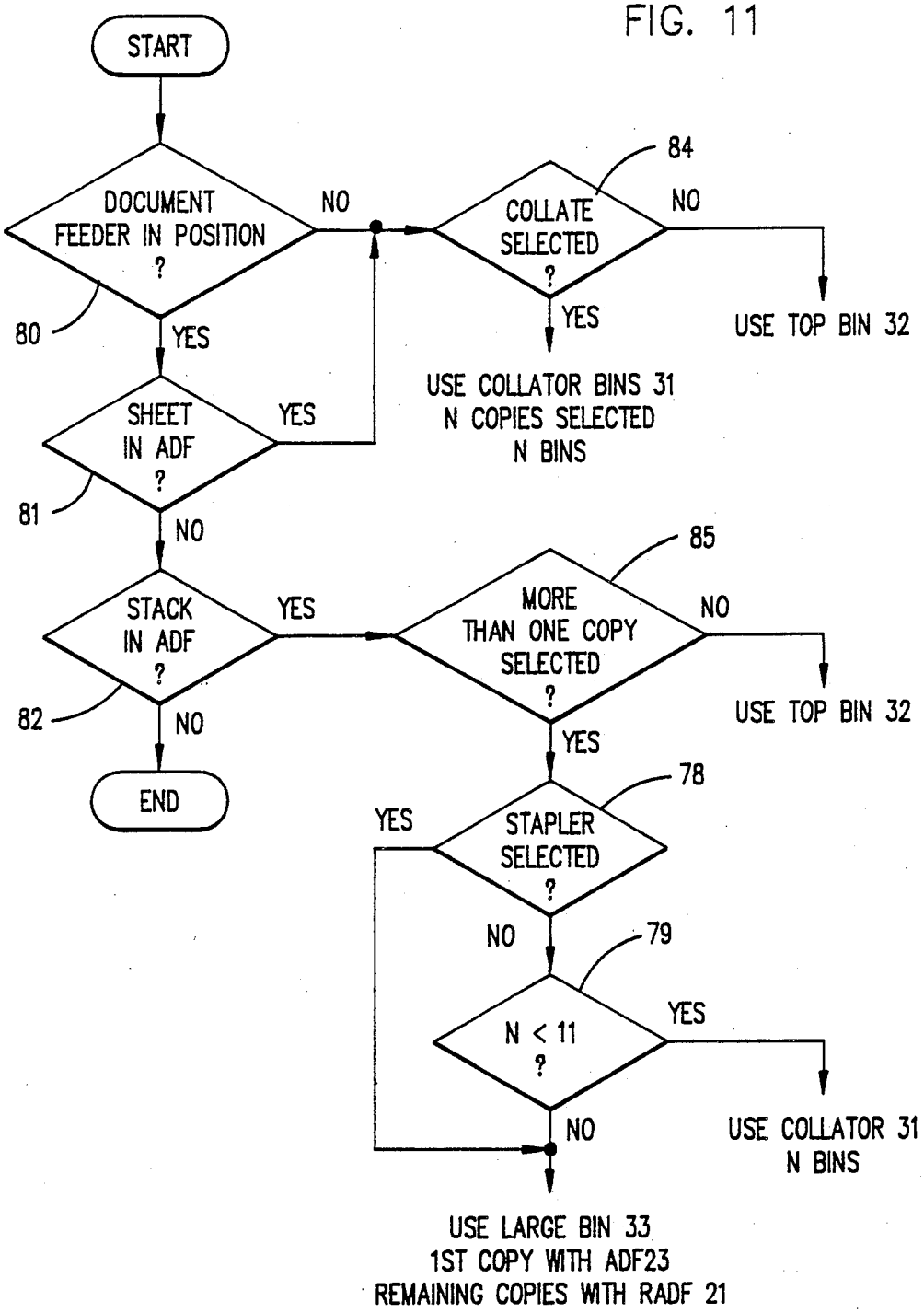
FIG. 11 is a controller means flow chart in accordance with the invention, which is somewhat like FIG. 9 in that operation of the ADF can be used to load the RADF, this embodiment also showing how the invention operates relative selection of a copy quantity greater than the number of available collate bins, and how this operation relates to selection of stapled copy sets.

In the embodiment of FIG. 11 ADF 23 may be used to make the first copy set, and to then load RADF 21, as has been described relative FIGS. *7a–7b*. Also, the operator may elect to use stapler 68 of FIG. 4. FIG. 11 also shows how a copy/set request greater than the number of collator bins is accommodated by the invention.

Within the spirit and scope of the invention, SADF 22 may also be used to make the first copy set, and to then load RADF 21.

In FIG. 11, decision block 80 determines if document feeder 20 is in position over platen 11, decision block 81 determines if an original document sheet has been inserted into SADF entry tray 40, and decision block 82 determines if an original document set has been inserted into ADF entry tray 46.

When document feeder 20 is not in position for use, decision block 84 determines if collator 31 has been selected for use by the operator. When the collator has not been selected, copy handler 30 is controlled by motive means 35 to locate top bin 32 at copier exit path 12 (i.e. members 62,63 of FIGS. 4 and 6), and all copy sheets are supplied to bin 32. When the collator has been selected, copy handler 30 is controlled by motive means 35 to locate the top collator bin at copier exit path 12, and all copy sheets are supplied to collator bins 31. In this situation, if the copy request is for N copies (where $N<11$), then the top N bins of collator 31 are used for the copy job.

When document feeder 20 is in position for use, decision block 81 determines if a sheet has been placed in the entry tray of SADF 22. If such a sheet exists, decision block 84 again determines if collator 31 has been selected for use by the operator, and the SADF supported copy job proceeds as above described relative a manual copy job.

When document feeder 20 is in position for use, decision block 82 determines if a stack of document sheets has been placed in the entry tray of ADF 23. If such a stack exists, decision block 85 determines if more than one copy has been requested by the operator. If only one copy has been requested, copy handler 30 is controlled by motive means 35 to locate the top bin 32 at copier exit path 12, and all copy sheets are supplied to bin 32.

If more than one copy has been requested, decision block 79 determines if use of stapler 68 has been requested by the operator.

If use of the stapler has been requested, copy handler 30 is controlled by motive means 35 to locate large bin 33 at copier exit path 12, and all stapled copy sets are supplied to this bin. In this situation, the first copy set is produced as ADF 23 feeds the original document set to platen 11 for one-time copying, and as the original document is thereafter fed to the entry tray 49 of RADF 21 (see FIG. *7a*). If N copy sets have been requested, the original document set is circulated to platen 11 N-1 times for one-time copying during each of the circulations (see FIG. *7b*). After copying of the document set for the Nth time, the original document set is placed in exit tray 24 for retrieval by the operator (see FIG. *7c*).

If use of the stapler has not been requested, decision block 79 determines if the requested number of copy sets N is greater than the number of available collator bins. In this case there are ten collator bins available.

If the number of copy sets N requested is less than eleven, then copy handler 30 is controlled by motive means 35 to locate the top collator bin at copier exit path 12, and the unstapled copy sheets are supplied to collator bins 31. In this situation, if the copy request is for N copies, then each original document sheet is copied N times and thereafter deposited in exit tray 24. The top N bins of collator 31 are used for the copy job, each of these bins receiving a copy set of the original document set, as the collator increments up N bins during the copying of each original document sheet, and then returns the top collator bin to exit path 12 in preparation for the copying of the next document sheet.

If the number of copy sets N requested is more than ten, i.e. more than the number of available collator bins, then copy handler 30 is controlled by motive means 35 to locate large bin 33 at copier exit path 12, and the unstapled copy sets are supplied to this bin. As before stated, the first copy set is produced while using ADF 23 to load the original document set into RADF 21, and the remaining of the copy sets are thereafter produced while using the RADF.

FIG. 12 shows a controller means flow chart for use with the document feeder 20 of FIG. 2, i.e. with a document feeder that allows the operator to queue a number of original document sets in ADF tray 46.

As will be recalled, in this embodiment of the invention a number of original document sets may be queued in ADF tray 46. Each such set comprises a different copy job, and each of these copy jobs may have different copy job parameters. Each of these queued document sets is separated from the upper adjacent set by a separator sheet. Optical sensor 54 of FIG. 2 is provided in the exit path of the ADF. Sensor 54 detects a characteristic hole(s) in the separator sheet as the sheet is fed to platen 11 by the ADF. This identifies the sheet as a separator sheet.

As a part of a job queuing setup, the operator uses control panel button 19 (FIG. 1) to indicate to controller 18 the number of sequential different copy jobs that have been entered by way of the control panel. When controller 18 receives an output from sensor 54 indicating that a copy job boundary has arrived, controlled 18 fetches the job parameters for the next job, and implements copying of this new set of original document sheets in accordance with the invention. Usually the job separator sheet includes printed identifier information, and the set separator sheet is copied, and becomes part of the copy set(s), for later use.

FIG. 12 is like FIG. 11 in that it shows a controller means embodiment in which ADF 23 may be used to make the first copy set, and to then load RADF 21, as was described relative FIGS. *7a–7b*, and wherein the operator may have also elect to use stapler 68 of FIG. 4.

In FIG. 12, decision block 80 determines if document feeder 20 is in position over platen 11, decision block 81 determines if an original document sheet has been inserted into SADF entry tray 40, and decision block 82 determines if an original document set(s) has been inserted into ADF entry tray 46.

When document feeder 20 is not in position for use, decision block 84 determines if collator 31 has been selected for use. When the collator has not been selected, copy handler 30 is controlled by motive means 35 to locate top bin 32 at copier exit path 12, and all copy sheets are supplied to this bin. When the collator has been selected, copy handler 30 is controlled by motive means 35 to locate the top collator bin at copier exit path 12, and all copy sheets are supplied to collator bins 31. In this situation, if the copy request is for N copies (where $N<11$), then the top N bins of collator 31 are used for the copy job.

When document feeder 20 is in position for use, decision block 81 determines if a stack of document sheets has been placed in the entry tray of SADF 22. If such a stack exists, decision block 84 again determines if collator 31 has been selected for use, and the SADF copy job proceeds as above described relative a manual copy job.

When document feeder 20 is in position for use, decision block 82 determines if a stack of document sheets has been placed in the entry tray of ADF 23. If such a stack exists, decision block 75 determines if the operator has indicated the queuing of a number of document sets in the ADF tray.

Assuming that jobs have not been queued, decision block 85 determines if more than one copy has been requested by the operator. If only one copy has been requested, copy handler 30 is controlled by motive means 35 to locate the top bin 32 at copier exit path 12, and all copy sheets are supplied to bin 32.

If more than one copy has been requested, decision block 79 determines if use of stapler 68 has been requested by the operator.

If use of the stapler has been requested, then copy handler 30 is controlled by motive means 35 to locate large bin 33 at copier exit path 12, and all stapled copy sets are supplied to this bin. In this situation, the first copy set is produced as ADF 23 feeds the original document set to platen 11 for one-time copying, and as the original document is thereafter fed to the entry tray 49 of RADF 21 (see FIG. 7*a*). If N copy sets have been requested, the original document set is now circulated to platen 11 N-1 times for one-time copying during each of the circulations (see FIG. 7*b*). After copying of the document set for the Nth time, the original document set is placed in exit tray 24 for retrieval by the operator (see FIG. 7*c*).

If use of the stapler has not been requested, then decision block 79 determines if the requested number of copy sets N is greater than the available number of collator bins. In this case there are ten collator bins available.

If the number of copy sets N requested is less than eleven sets, then copy handler 30 is controlled by motive means 35 to locate the top collator bin at copier exit path 12, and the unstapled copy sheets are supplied to collator bins 31. In this situation, if the copy request is for N copies, each original document sheet is copied N times and the original document sheet is thereafter deposited in exit tray 24. The top N bins of collator 31 are used for the copy job, each of these bins receiving a copy set of the original document set, as the collator increments up N bins during the copying of each original document sheet, and then returns the top collator bin to exit path 12 in preparation for the copying of the next document sheet.

If the number of copy sets N requested is more than ten, copy handler 30 is controlled by motive means 35 to locate large bin 33 at copier exit path 12, and the unstapled copy sets are supplied to bin 33. As indicated, the first copy set is produced while ADF 23 loads the original document set into RADF 21, and the remaining of the copy sets are produced while using the RADF to recirculate the document to the platen.

While the present invention has been described in detail with reference to preferred embodiments thereof, it is appreciated that those of skill in the art will, upon learning of the invention, visualize yet other embodiments thereof. For this reason, the scope and spirit of the invention is not to be limited by the foregoing detailed description.

What is claimed is:

1. Copier apparatus having an imaging station for receiving an original document to be copied, and providing copy sheets to an exit paper path, comprising;

(A) a multi-function original document handler for presenting original document sheets to said imaging station for copying, said document handler being capable of operating in
  (1) an automatic document feed (ADF) mode,
  (2) a recirculating automatic document feed (RADF) mode,
  (3) a semi automatic document feed (SADF) mode, or
  (4) a manual document feed mode, (B) means responsive to the document handler function that is selected by an operator, (C) a multi-function output copy handler for receiving said copy sheets, said copy handler having
  (1) an exit tray for receiving copy sheets,
  (2) a collator having a plurality of bins, each bin of which is adapted to receive all of the copy sheets that comprise one copy set, and wherein similar-image copy sheets are delivered one to each of said bins prior to copying of the next sheet of an original document, and
  (3) a single stacker bin capable of holding a plurality of copy sets in a stack of sets, (D) input means facilitating operator input of copy job parameters, including the quantity of copies to be made and use of said collator, and (E) control means operative to control said output copy handler in response to said means responsive to the document handler function that is selected by an operator, and said input means, to thereby cause said output copy handler to
  (1) supply copy sheets to said exit tray when said document handler is to operate in said manual mode, and use of said collator is not selected,
  (2) supply copy sheets to said collator bins when said document handler is to operate in said manual mode, and use of said collator is selected,
  (3) supply copy sheets to said exit tray when said document handler is to operate in said SADF mode, and use of said collator is not selected,
  (4) supply copy sheets to said collator bins when said document handler is to operate in said SADF mode, and use of said collator is selected, (5) supply copy sheets to said exit tray when said document handler is to operate in said ADF mode, and one copy is selected, and (6) supply copy sheets to said collator bins when said document handler is to operate in said ADF mode, and more than one copy is selected.

2. The copier apparatus of claim 1 wherein said control means is additionally operative to control said output copy handler in response to said means responsive to the document handler function that is selected by an operator, and said input means, to thereby cause said output copy handler to (7) supply copy sheets to said exit tray when said document handler is to operate in said RADF mode, and one copy is selected, and (8) supply copy sheets to said stacker bin when said document handler is to operate in said RADF mode, and more than one copy is selected.

3. The copier apparatus of claim 2 wherein said input means facilitating operator input of copy job parameters including an interrupt request whereby an RADF copy job in process is temporarily interrupted to allow an SADF/ADF copy job to be performed, and wherein upon the occurrence of such an interrupt request, the said RADF copy job continues until all sheets of an original document have been copied, whereupon the SADF/ADF copy job is performed, and said RADF copy job is thereafter resumed.

4. The copier apparatus of claim 3 wherein a portion of said output copy handler not utilized by said interrupted RADF copy job is utilized to perform said interrupting SADF/ADF copy job.

5. The copier of claim 2 including (F) set offsetting means operable to deliver alternate copy sets to said stacker bin in physically offset fashion.

6. The copier apparatus of claim 1 including (F) set accumulator tray means located in said exit copy path and communicating with said copy handler, and (G) operator selectable set binding means mounted at said accumulator tray means, wherein said control means is additionally operative to automatically control said output copy handler in response to operator selection of said binding means, to thereby cause said output copy handler to (7) supply copy sheets to said collator when said document handler is to operate in said ADF mode, and more than one copy is selected, and use of said binding means is not selected, and (8) supply copy sheets to said stacker bin when said document handler is to operate in said ADF mode, and more than one copy is selected, and use of said binding means is selected.

7. The copier apparatus of claim 6 wherein said input means facilitates operator input of an interrupt request, whereby an RADF copy job in process may be temporarily interrupted to allow an ADF copy job to be performed, and wherein upon the occurrence of such an interrupt request, the said RADF copy job continues until all sheets of an original document have been copied, whereupon the ADF copy job is performed, and thereafter said RADF copy job is resumed.

8. The copier apparatus of claim 7 wherein a portion of said output copy handler not utilized by said interrupted RADF copy job is utilized to perform said interrupting ADF copy job.

9. The copier apparatus of claim 8 including (H) set offsetting means operable to deliver alternate copy sets from said set accumulator tray means to said stacker bin in physically offset manner.

10. Copier apparatus, comprising;

original document feeding means for receiving a multi-sheet original document set to be copied, said document feeding means being selectively capable of operating in (1) a recirculating automatic document feed (RADF) mode in which said document feeding means is adapted to receive said multi-sheet original document set for copying, (2) an automatic document feed (ADF) mode in which said document feeding means is adapted to receive said multi-sheet original document set for copying, (3) a semi automatic document feed (SADF) mode in which said document feeding means is adapted to receive said multi-sheet document set, one sheet at a time, for copying, (4) a manual feed mode in which said document feeding means is adapted to receive said multi-sheet original document set, one sheet at a time, for copying, multi function copy sheet receiving means including (1) a collator having at a plurality of individual bins, each bin of which is adapted to receive the sheets that comprise one copy set, wherein similar-image copy sheets are delivered one sheet to each of a number of said collator bins prior to copying of the next sheet of said multi-sheet original document set, and (2) stacker bin means capable of holding a plurality of copy sets in a unitary stack, and control means operable to select use of said collator when said multi-sheet original document set is copied using said ADF, SADF or manual document feed modes, and operable to select use of said stacker bin means when said multi-sheet original document set is copied using said RADF document feed mode.

11. The copier apparatus of claim 10 including a copy set accumulator tray located prior to said copy sheet receiving means, and means operable upon selection of said RADF document feed mode to accumulate all sheets of a copy set in said accumulator tray prior to the delivery of said accumulated copy set to said stacker bin means.

12. The copier apparatus of claim 11 including means operable to stack alternate copy sets physically offset in said stacker bin means.

13. The copier apparatus of claim 12 including set binding means located at said accumulator tray, and control means selectively operable to effect binding of said accumulated copy sets prior to delivery of the same to said stacker bin means.

14. The copier apparatus of claim 13 including interrupt request means whereby a copy job in process may be temporarily interrupted to allow another copy job to be performed, and wherein upon the occurrence of such an interrupt request, a portion of said document handler not being utilized by said copy job in process is utilized to perform said another copy job.

15. A multi-function output copy handler for use with a copy set reproduction device, said reproduction device having a sheet discharge path which occupies a generally horizontal X-Y plane, and out of which copy sheets exit said reproduction device while moving in an X direction, comprising;

a generally horizontal sheet accumulator tray, said accumulator tray having an entrance which receives individual sheets from said reproduction device, to accumulate said sheets into a copy set, and having an exit from which copy sets are discharged, a movable gate located at the exit of said accumulator tray, said gate having an open position which allows copy sheets to pass directly through said accumulator tray, and having a closed position which prevents copy sheets from exiting said accumulator tray, selectively operable sheet binding means located at said accumulator tray, said binding means being operable, when selected for use, to bind a group of copy sheets within said accumulator tray into a bound copy set, set feeding means associated with the exit of said accumulator tray, operative to impart a component of movement in a Y direction to at least alternate copy sets exiting said accumulator tray, a vertical Z direction stack of collator bins having an top bin and a bottom bin, a copy exit bin located above the top bin of said stack of bins, a large capacity stacker bin located under the bottom bin of said stack of collator bins, common motive means for bidirectionally moving said exit bin, said stacker bin and said collator bins as a unit in said vertical Z direction, and control means operable to control said common motive means so as to selectively (1) position said stacker bin at the exit of said accumulator tray when said binding means is selected for use, and to thereafter lower said stacker bin as copy sets exit said accumulator tray, or (2) position the top one of said collator bins at the exit of accumulator tray when said binding means is not selected for use, and to thereafter raise said collator bins as copy sets exit said accumulator tray.

16. In combination, a document handler/copying device selectively operable to produce copies of an original document in one of the following modes (1) - a copy mode wherein a selected number of copies of a single document page are produced prior to the copying of another document page, (2) - a collate mode wherein a selected number of copies of each page of a multi-page document are sequentially produced, and (3) - a set mode wherein one copy of each document page of a multi-page document are produced for all pages of the multi-page document, and wherein the copy process is repeated a selected number of times, to thereby produce a copy set during each one of the selected number of repetitions of the copy process, a copy output handler receiving copy output from said copying device, said output handler having (1) - relatively small sheet capacity output tray means, (2) - multi-bin collator means having bins of individually relatively small sheet capacity, and (3) - relatively large capacity set output tray means, and control means responsive to the mode selected for operation of said document handler/copying device, and operable to control said copy output handler to (1) - render said copy output tray means operable upon selection of said copy mode, (2) - render said multi-bin collator means operative upon selection of said collate mode, and (3) - render said set output tray means operable upon selection of said set mode.

17. The combination defined in claim 16 wherein said document handler includes;

recirculating automatic document feeding means, additional document feeding means, and said control means responsive to said document handler/copying device being selected to produce copies of an original document in said set mode to (1) produce a first copy set, and (2) thereafter load said original document into said recirculating automatic document feeding means, and (3) thereafter produce all remaining copy sets of said original document using said recirculating automatic document feeding means.

18. The combination of claim 17 including original document exit tray means, and means effecting the feeding said original document to said exit tray means after the copying thereof after the production of the last one of said remaining copy sets.

19. Copier apparatus, comprising;

copier engine means having a viewing station for receiving original document sheets to be copied, original document feeding means for receiving original document sheets to be copied and for feeding said sheets to said viewing station, said document feeding means being selectively capable of operating in (1) a recirculating automatic document feed (RADF) mode, (2) an automatic document feed (ADF) mode, (3) a semi automatic document feed (SADF) mode, or (4) a manual feed mode, copy sheet receiving means for receiving copy sheets produced from said original document sheets by said copier engine means, including (1) operator selectable copy set binding means, (2) collator means having at the plurality N of individual collator bins, (3) stacker bin means, and (4) output bin means, and control means operable to (1) select use of said output bin means when only one copy of original document sheets is produced using said ADF, SADF or manual document feed modes, (2) select use of said collator means when no greater than N copies of original document sheets are produced using said ADF document feed mode and said binding means is not selected for use, (3) select use of said stacker bin means when more than N copies of original document sheets are produced using said ADF document feed mode, or when said binding means is selected for use, whereupon the first of said copies is produced using said ADF document feed mode and subsequent copies are produced using said RADF document feed mode.

20. The copier apparatus of claim 19 including interrupt request means facilitating interruption of a copy job in process to allow another copy job to be performed, wherein upon the occurrence of an interrupt request a portion of said copy sheet receiving means not utilized by said copy job in process is utilized to perform said another copy job.

* * * * *